US011732855B2

(12) United States Patent
Han

(10) Patent No.: US 11,732,855 B2
(45) Date of Patent: Aug. 22, 2023

(54) LAMP MODULE AND VEHICLE LAMP INCLUDING THE SAME

(71) Applicant: SL Corporation, Daegu (KR)

(72) Inventor: Hyo Jin Han, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/864,813

(22) Filed: Jul. 14, 2022

(65) Prior Publication Data

US 2023/0066763 A1 Mar. 2, 2023

(30) Foreign Application Priority Data

Aug. 25, 2021 (KR) ..... 10-2021-0112290

(51) Int. Cl.

| | |
|---|---|
| ***F21S 41/143*** | (2018.01) |
| ***F21S 41/24*** | (2018.01) |
| ***F21S 41/255*** | (2018.01) |
| ***F21S 41/148*** | (2018.01) |
| ***F21S 41/32*** | (2018.01) |
| ***F21S 43/243*** | (2018.01) |
| ***F21S 43/247*** | (2018.01) |
| ***F21S 43/241*** | (2018.01) |
| ***F21S 43/40*** | (2018.01) |
| ***F21Y 115/10*** | (2016.01) |
| ***F21S 43/31*** | (2018.01) |

(52) U.S. Cl.

CPC ..... *F21S 41/143* (2018.01); *F21S 41/148* (2018.01); *F21S 41/24* (2018.01); *F21S 41/255* (2018.01); *F21S 41/322* (2018.01); *F21S 43/241* (2018.01); *F21S 43/243* (2018.01); *F21S 43/247* (2018.01); *F21S 43/40* (2018.01); *F21S 43/315* (2018.01); *F21Y 2115/10* (2016.08)

(58) Field of Classification Search

CPC ..... F21S 41/143; F21S 41/24; F21S 41/255; F21S 41/148; F21S 41/26; F21S 41/322; F21S 41/147; F21S 43/239; F21S 43/315; F21S 43/243; F21S 43/247; F21S 43/40; F21S 43/241; F21S 43/265; F21Y 2115/10

See application file for complete search history.

(56) References Cited

U.S. PATENT DOCUMENTS

| | | | | |
|---|---|---|---|---|
| 2008/0151567 | A1* | 6/2008 | Albou | F21S 41/663 362/507 |
| 2011/0216549 | A1* | 9/2011 | Futami | B60Q 1/0041 362/520 |
| 2017/0030543 | A1* | 2/2017 | Gromfeld | F21S 41/322 |
| 2017/0241606 | A1* | 8/2017 | Courcier | F21S 41/25 |
| 2018/0087732 | A1* | 3/2018 | De Lamberterie | F21S 41/16 |
| 2018/0356582 | A1* | 12/2018 | Sousek | F21S 43/243 |
| 2019/0186708 | A1* | 6/2019 | Ecker-Endl | F21S 41/27 |
| 2019/0299853 | A1* | 10/2019 | Fleurence | F21V 5/048 |

* cited by examiner

*Primary Examiner* — Erin Kryukova

(74) *Attorney, Agent, or Firm* — United One Law Group LLC; Kongsik Kim; Jhongwoo Peck

(57) ABSTRACT

A lamp module includes a light source unit that generates light; a light guide unit that guides the light incident on an incidence portion from the light source unit to be emitted to an emission portion; and an optical unit that transmits the light emitted from the light guide unit to allow a predetermined beam pattern to be formed. In particular, the optical unit includes a plurality of lenses disposed in a vehicle width direction, and the emission portion includes a plurality of emission surfaces disposed in the vehicle width direction to correspond to the plurality of lenses.

11 Claims, 12 Drawing Sheets

LAMP MODULE AND VEHICLE LAMP INCLUDING THE SAME

CROSS-REFERENCE TO RELATED APPLICATION(S)

This application claims priority from Korean Application No. 10-2021-0112290 filed on Aug. 25, 2021, which application is incorporated herein by reference in its entirety.

BACKGROUND

1. Technical Field

The present disclosure relates to a lamp module and a vehicle lamp including the same, and more specifically, to a lamp module capable of implementing a slim design while simplifying a configuration, and a vehicle lamp including the same.

2. Description of the Related Art

Vehicles are provided with various types of lamps for an illumination function that allows a driver to easily identify objects located around a vehicle while operating in low-light conditions (e.g., night-time driving), and a signaling function that allows a state of a vehicle to be notified to surrounding vehicles or pedestrians.

For example, headlamps and fog lamps mainly serve the illumination function, and daytime running lamps, position lamps, turn signal lamps, tail lamps, brake lamps, and the like mainly serve the signaling function. The installation criteria and standards of each lamp are stipulated by laws and regulations to sufficiently function.

In recent years, not only the functional aspect for helping safe driving by enabling the driver's visibility, which is the basic role of vehicle lamps, but also the aesthetic aspect perceived by consumers through design improvement has a great influence on consumers' purchase decisions.

To this end, research is being actively conducted to improve an exterior design by configuring the vehicle lamps with a slimmer design to form an optimal beam pattern, while implementing a slim shape using a plurality of lamp modules.

Since the vehicle lamps with a slim design have a relatively small installation space, and placement of the components for forming the beam pattern in the small space is limited, there is a need for a means for reducing the number of parts to simplify the configuration, while implementing the slim design.

SUMMARY

The present disclosure is directed to providing a lamp module capable of reducing the number of parts configuring each of a plurality of lamp modules in order to implement a slim design by disposing the plurality of lamp modules in a vehicle's width direction, and a vehicle lamp including the same.

Objects of the present disclosure are not limited to the above-described objects, and other objects not mentioned will be clearly understood by those skilled in the art from the following description.

According to an aspect of the present disclosure, a lamp module may include a light source unit that generates light; a light guide unit that guides the light incident on an incidence portion from the light source unit to be emitted to an emission portion; and an optical unit that transmits the light emitted from the light guide unit to allow a predetermined beam pattern to be formed. In particular, the optical unit may include a plurality of lenses disposed in a vehicle width direction, and the emission portion of the light guide unit may include a plurality of emission surfaces disposed in the vehicle width direction to correspond to the plurality of lenses of the optical unit.

The light guide unit may further include a transmission portion configured to transmit the light incident on the incidence portion to the emission portion that is disposed in front of the incidence portion, and the transmission portion may be formed to extend in a front-rear direction. The light guide unit may further include a reflection portion including at least one reflection surface configured to reflect the light incident on the incidence portion to the transmission portion. A lower surface of the transmission portion may be disposed at or near an optical axis of the optical unit, and a front end of the transmission portion may be disposed at or near a rear focal point of the optical unit.

Each of the plurality of emission surfaces may exhibit a planar shape or a curved surface.

The plurality of lenses may have a stepped portion such that the plurality of lenses are disposed progressively forward or rearward going from one side toward the other side in the vehicle width direction, and the plurality of emission surfaces may have a stepped portion corresponding to an arrangement of the plurality of lenses.

Each of the plurality of lenses and the plurality of emission surfaces may be respectively formed in an odd number.

According to another aspect of the present disclosure, a vehicle lamp may be configured to allow a predetermined beam pattern to be formed by at least one lamp module. The at least one lamp module may include a plurality of lamp modules disposed in a vehicle width direction. Each of the plurality of lamp modules may include a light source unit that generates light; a light guide unit that guides the light incident from the light source unit to be emitted to an emission portion; and an optical unit that transmits the light emitted from the light guide unit to allow the predetermined beam pattern to be formed. In particular, the optical unit may include a plurality of lenses disposed in the vehicle width direction, and the emission portion of the light guide unit may include a plurality of emission surfaces disposed in the vehicle width direction to correspond to the plurality of lenses of the optical unit.

The plurality of lamp modules may be disposed to be inclined forward or rearward going from one side toward the other side in the vehicle width direction.

The plurality of lamp modules may be divided into a first group configured to form a first region of the beam pattern and a second group configured to form a second region of the beam pattern, and the plurality of emission surfaces of a lamp module belonging to the first group of the plurality of lamp modules may have curvatures different from curvatures of the plurality of emission surfaces of a lamp module belonging to the second group of the plurality of lamp modules.

The lamp module belonging to any one of the first group or the second group may have the plurality of emission surfaces with a curved shape, and the lamp module belonging to the other group may have the plurality of emission surfaces with a planar shape.

A lamp module and a vehicle lamp including the same according to the present disclosure may provide one or more of the following effects. A plurality of lamp modules include a plurality of lenses, and a light source unit configured to generate light that transmits through each of the plurality of lenses, and a light guide unit configured to guide the light generated from the light source unit to the plurality of lenses are commonly used, so that a slimmer form factor may be implemented while being able to simplify the configuration. The effects of the present disclosure are not limited to the above-described effects, and other effects not mentioned will be clearly understood by those skilled in the art from the following description.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
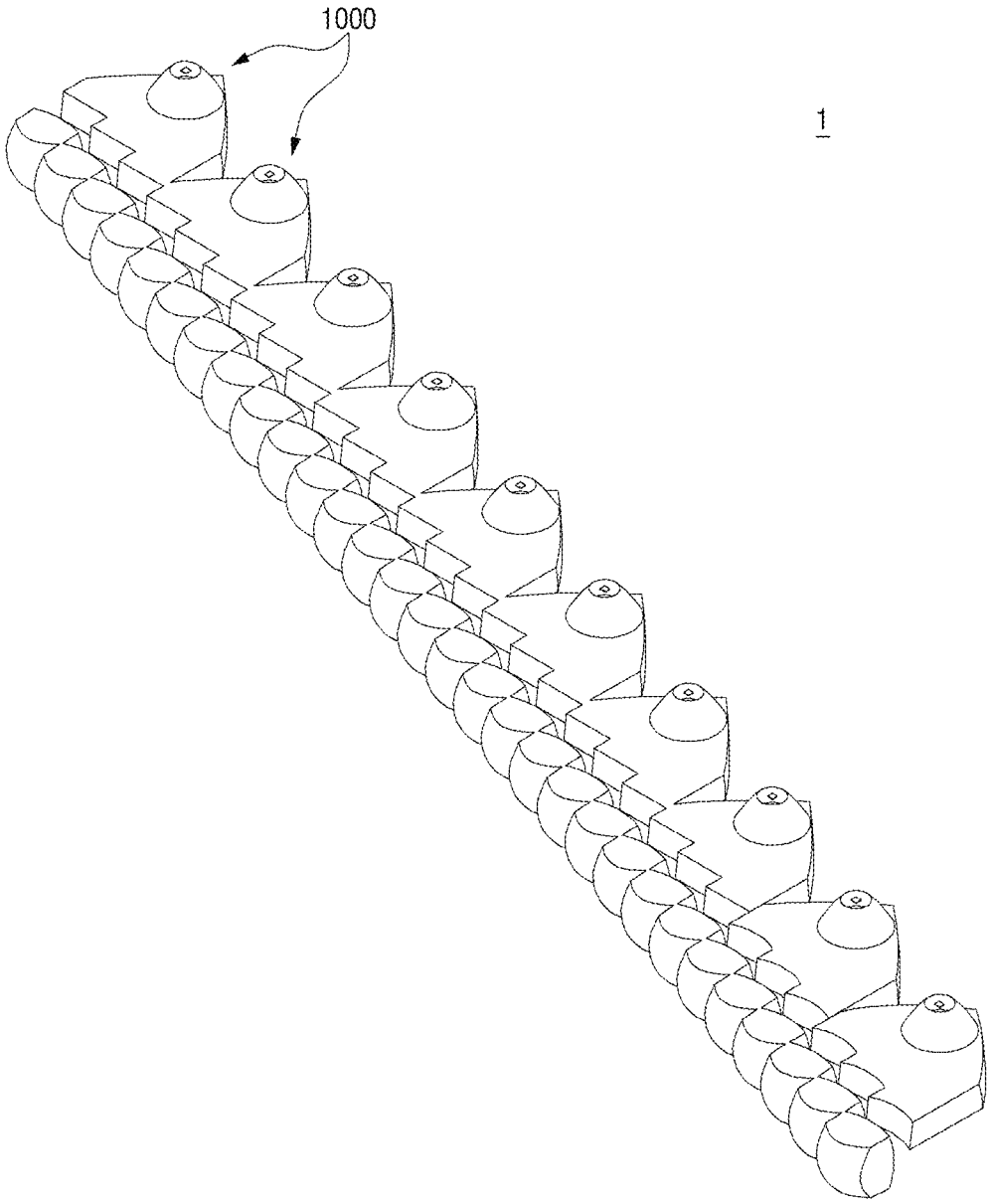
FIGS. 1 and 2 are perspective views showing a vehicle lamp according to an embodiment of the present disclosure.

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements.

In some embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing a vehicle lamp according to embodiments of the present disclosure.

Figure 2:
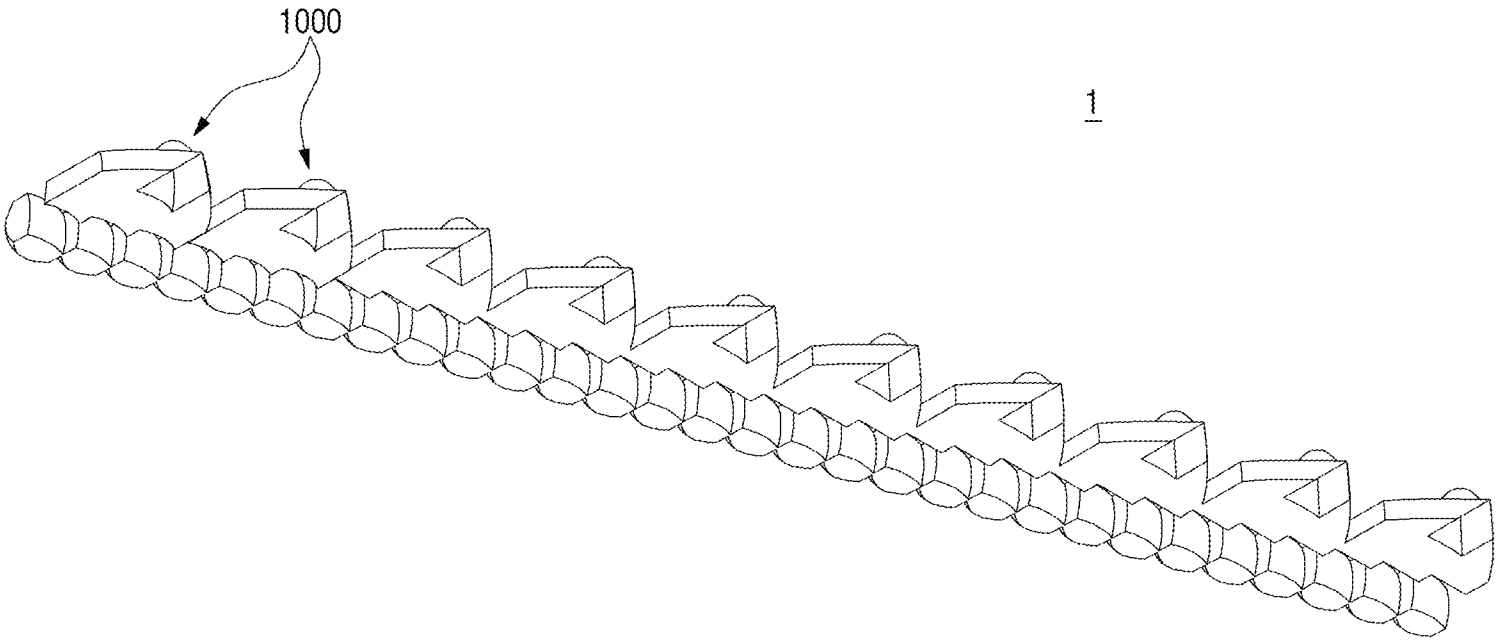
Figure 3:
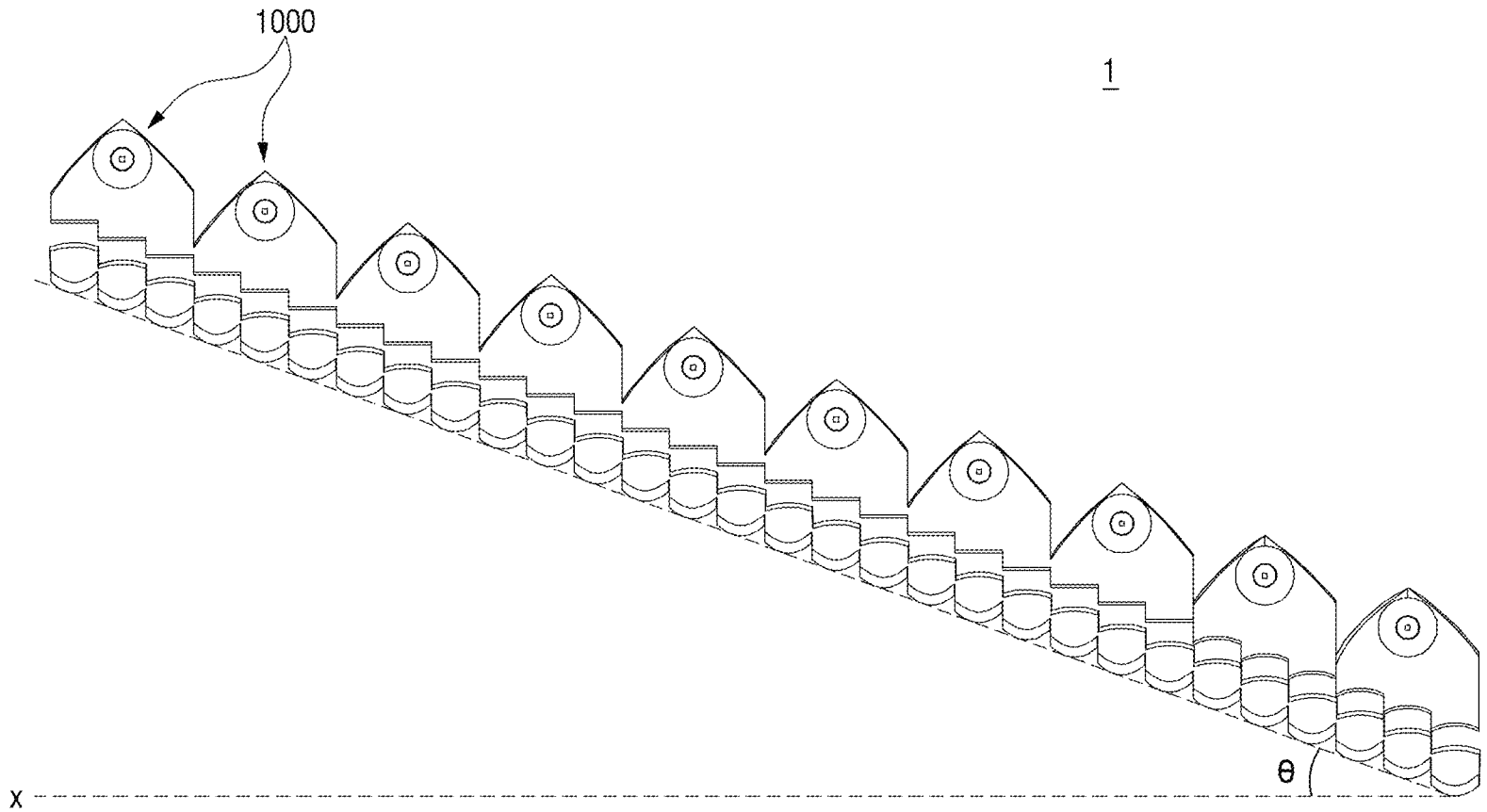
FIG. 3 is a plan view showing the vehicle lamp according to the embodiment of the present disclosure.
Figure 4:
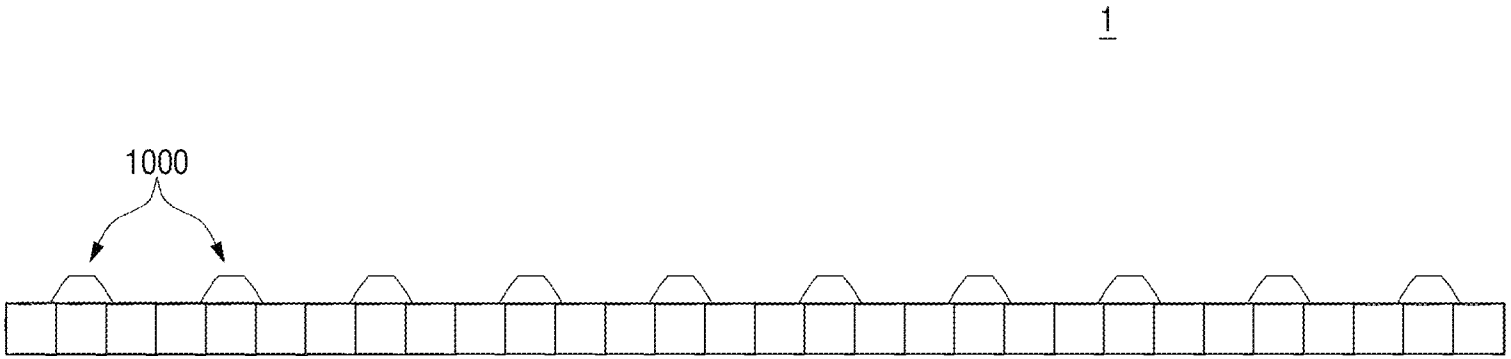
FIG. 4 is a front view showing the vehicle lamp according to the embodiment of the present disclosure.

FIGS. 1 and 2 are perspective views showing a vehicle lamp according to an embodiment of the present disclosure, FIG. 3 is a plan view showing the vehicle lamp according to the embodiment of the present disclosure, and FIG. 4 is a front view showing the vehicle lamp according to the embodiment of the present disclosure. Referring to FIGS. 1 to 4, a vehicle lamp 1 according to an embodiment of the present disclosure may include a plurality of lamp modules 1000 arranged in a vehicle width direction x.

In the embodiment of the present disclosure, the vehicle lamp 1 may be used as a head lamp to allow a front view to be secured by radiating light in a traveling direction of a vehicle. However, the present disclosure is not limited thereto, and the vehicle lamp 1 according to the present disclosure may be used as various lamps installed in a vehicle, such as a tail lamp, a daytime running lamp (DRL), a brake lamp, a turn signal lamp, a backup lamp, or the like, as well as a head lamp.

When the vehicle lamp 1 according to the present disclosure is used as a head lamp, the vehicle lamp 1 according to the present disclosure may form a low beam pattern to allow a wide viewing range in a shorter distance in front of a vehicle to be secured, or a high beam pattern to allow a longer viewing distance for a remote distance in front of a vehicle to be secured. Hereinafter, in the embodiment of the present disclosure, a case in which the vehicle lamp 1 forms a low beam pattern that radiates light to a lower side with respect to a predetermined cutoff line will be described as an example.

As shown in FIG. 3, the plurality of lamp modules 1000 may be disposed to be inclined at a predetermined angle θ with respect to the vehicle width direction x and may be arranged from one side toward the other side in the vehicle width direction x. Such a configuration may allow the plurality of lamp modules 1000 to be arranged conforming the shape of an exterior body contour of a vehicle in which the vehicle lamp 1 according to the present disclosure is installed.

In other words, in the vehicle lamp 1 according to the present disclosure, the plurality of lamp modules 1000 may be disposed in an internal space formed by a lamp housing (not shown) and a cover lens (not shown) coupled to the lamp housing, and in such case, the plurality of lamp modules 1000 may be arranged according to the shape of an outer surface of the cover lens that forms the body line of the vehicle.

In the embodiment of the present disclosure, a case in which the plurality of lamp modules 1000 are disposed more rearward going from the inner side toward the outer side of a vehicle in the vehicle width direction x will be described as an example, but this is only an example for better understanding of the present disclosure, and the present disclosure is not limited thereto. The plurality of lamp modules 1000 may be disposed to be inclined and may be arranged more forward or rearward going from one side toward the other side in the vehicle width direction x along the body line of the vehicle.

Figure 5:
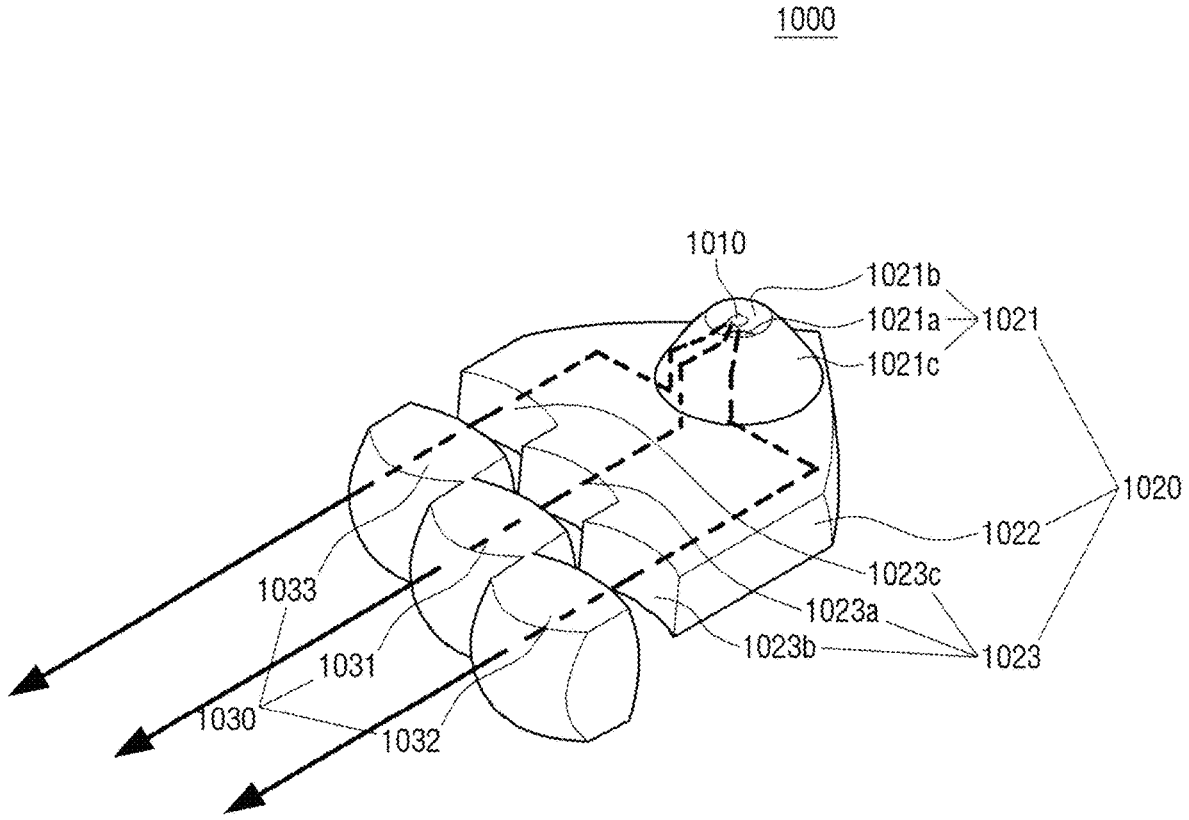
FIGS. 5 and 6 are perspective views showing a lamp module according to the embodiment of the present disclosure.
Figure 6:
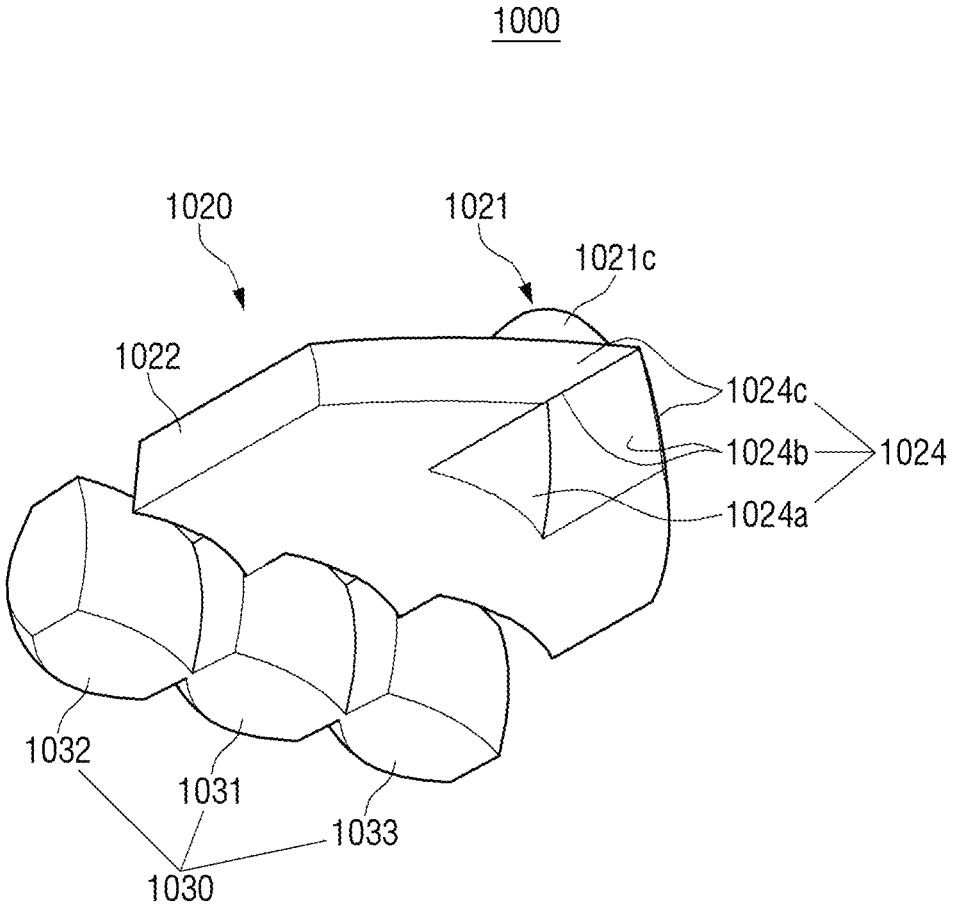
Figure 7:
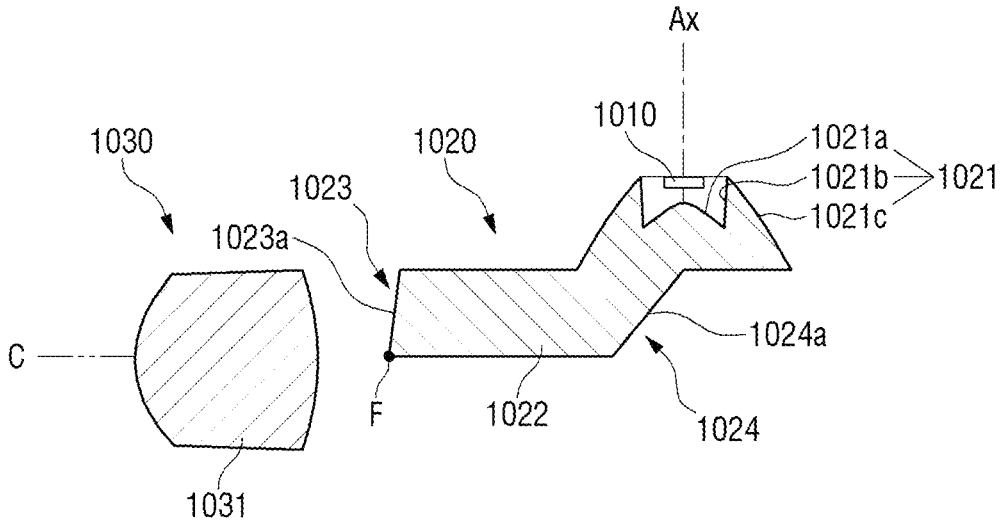
FIG. 7 is a cross-sectional view showing the lamp module according to the embodiment of the present disclosure.

FIGS. 5 and 6 are perspective views showing a lamp module according to the embodiment of the present disclosure, and FIG. 7 is a cross-sectional view showing the lamp module according to the embodiment of the present disclosure. FIGS. 4 to 7 show an example of any one of the plurality of lamp modules 1000, and the remaining lamp modules may be implemented similarly, with some minor differences in locations of components.

Referring to FIGS. 5 to 7, the lamp module 1000 according to the embodiment of the present disclosure may include a light source unit 1010, a light guide unit 1020, and an optical unit 1030.

The light source unit 1010 may include at least one light source configured to generate light having a light amount and/or a color suitable for a beam pattern to be formed by the vehicle lamp 1 according to the present disclosure, and in the embodiment of the present disclosure, a semiconductor light emitting device such as a light emitting diode (LED) will be described as an example for the at least one light source. However, the present disclosure is not limited thereto, and various types of light sources such as a laser diode (LD), a bulb, or the like, as well as an LED may be used as the light source unit 1010.

The light guide unit 1020 may guide the light incident from the light source unit 1010 to allow the light generated from the light source unit 1010 to be transmitted to the optical unit 1030 disposed in front of the light guide unit 1020 such that a beam pattern may be formed.

The light guide unit 1020 may include an incidence portion 1021, a transmission portion 1022, and an emission portion 1023. The incidence portion 1021 may include at least one incident surface 1021*a* and 1021*b* and a reflective surface 1021*c* that reflects some of the light incident on the at least one incident surface 1021*a* and 1021*b* in a direction of an optical axis Ax of the light source unit 1010. Herein, the optical axis Ax of the light source unit 1010 may be understood as a line that vertically passes through a center of a light emitting surface formed by the at least one light source.

The at least one incident surface 1021*a* and 1021*b* may include a center surface 1021*a* having the optical axis Ax of the light source unit 1010 at a center thereof and a protruding surface 1021*b* that protrudes from an outer circumferential end of the center surface 1021*a* toward the light source unit 1010, and the reflective surface 1021*c* may reflect the light incident on the protruding surface 1021*b* in the direction of the optical axis Ax of the light source unit 1010. The protruding surface 1021*b* may allow the light from the light source unit 1010 to be incident on the incidence portion 1021 with a minimal loss, while allowing a size of the incidence portion 1021 to be reduced.

In other words, without the protruding surface 1021*b*, the center surface 1021*a* would be required to have a size that correspond to a radiation range of the light generated from the light source unit 1010 in order to allow the light from the light source unit 1010 to be incident on the incidence portion 1021 without light loss. In such a configuration, it is necessary to relatively increase the size of the incidence portion 1021. Conversely, in the embodiment of the present disclosure, the size of the center surface 1021*a* may be reduced due to the protruding surface 1021*b*, and the light from the light source unit 1010 may still be incident on the incidence portion 1021 with a minimal loss.

The transmission portion 1022 may transmit the light incident on the incidence portion 1021 to the emission portion 1023, and in the embodiment of the present disclosure, since the optical axis Ax of the light source unit 1010 is vertically oriented, and the transmission portion 1022 is formed to extend in the front-rear direction, the light incident through the incidence portion 1021 may be reflected to proceed to the transmission portion 1022 by the reflection portion 1024 that includes at least one reflective surface 1024*a*, 1024*b*, and 1024*c* to allow the light incident on the incidence portion 1021 to proceed to the transmission portion 1022.

In the embodiment of the present disclosure, a case in which the reflection portion 1024 includes the plurality of reflection surfaces 1024*a*, 1024*b*, and 1024*c* will be described as an example, but this is only an example for better understanding of the present disclosure. The present disclosure is not limited thereto, and the number, locations, and sizes of the reflection surfaces included in the reflection portion 1024 may be variously changed depending on the size and/or shape of the optical unit 1030.

The transmission portion 1022 may include a lower surface that is disposed at or near an optical axis C of the optical unit 1030, and a front end of the transmission portion 1022 may be disposed at or near a rear focal point F of the optical unit 1030 to prevent the light from being incident on the optical unit 1030 through the lower half with respect to the rear focal point F of the optical unit 1030, so that a low beam pattern in which light is radiated to a lower side with respect to a predetermined cutoff line may be formed by the vehicle lamp 1 according to the present disclosure.

The emission portion 1023 may emit the light transmitted by the transmission portion 1022 to proceed to the optical unit 1030, and a shape and/or curvature of the emission portion 1023 may be variously changed depending on a region where the light is to be radiated by the lamp module 1000.

In the embodiment of the present disclosure, a case in which the emission portion 1023 includes a plurality of emission surfaces 1023*a*, 1023*b*, and 1023*c* that are disposed along the vehicle width direction x will be described as an example, and hereinafter, in the embodiment of the present disclosure, the plurality of emission surfaces 1023*a*, 1023*b*, 1023*c* may include a first emission surface 1023*a* disposed in the middle, and a second emission surface 1023*b* and a third emission surface 1023*c* disposed at both sides of the first emission surface 1023*a*, respectively.

In the embodiment of the present disclosure, the emission portion 1023 may include the plurality of emission surfaces 1023*a*, 1023*b*, and 1023*c* because the optical unit 1030, to be described below, includes a plurality of lenses 1031, 1032, and 1033. In the embodiment of the present disclosure, the plurality of lenses 1031, 1032, and 1033 may also include a first lens 1031 disposed in the middle, and a second lens 1032 and a third lens 1033 disposed at both sides of the first lens 1031, similar to the plurality of emission surfaces 1023*a*, 1023*b*, and 1023*c*. A detailed description of such a configuration will be provided below. Herein, the plurality of lenses 1031, 1032, and 1033 may not be physically separated, but may be connected with one another. However, each of the plurality of lenses 1031, 1032, and 1033 may be understood as functioning as an independent optical lens even though they are connected.

Further, since the emission portion 1023 includes the plurality of emission surfaces 1023*a*, 1023*b*, and 1023*c*, the reflection portion 1024 may also include a plurality of reflection surfaces 1024*a*, 1024*b*, and 1024*c* to reflect the light incident through the incidence portion 1021 to each of the plurality of emission surfaces 1023*a*, 1023*b*, and 1023*c*. The plurality of reflection surfaces 1024*a*, 1024*b*, and 1024*c* may include a first reflection surface 1024*a* for reflecting the light incident on the incidence portion 1021 to the first emission surface 1023*a*, a second reflection surface 1024*b* for reflecting the light incident on the incidence portion 1021 to the second emission surface 1023*b*, and a third reflection surface 1024*c* for reflecting the light incident on the incidence portion 1021 to the third emission surface 1023*c*. The second reflection surface 1024*b* and the third reflection surface 1024*c* may be disposed and formed at both sides of the first emission surface 1023*a*, so that the light incident on the incidence portion 1021 may be emitted through each of the second emission surface 1023*b* and the third emission surface 1023*c*.

The first reflection surface 1024*a* may be formed to be inclined so that a lower end is disposed more forward than an upper end thereof. The second reflection surface 1024*b* may be formed at each side of the first reflection surface 1024*a* so that a lower end is disposed farther from the optical axis Ax of the light source unit 1010 than an upper end thereof in the vehicle width direction x. The third reflection surface 1024*c* may be formed at each side so that a front end is disposed farther from the line that passes through the optical axis Ax of the light source unit 1010 with respect to both the front-rear direction and the vehicle width direction x so that the light reflected by the second reflection surface 1024*b* in the vehicle width direction x may proceed in a forward direction.

Meanwhile, in FIG. 7, the first emission surface 1023*a*, the first reflection surface 1024*a*, and the first lens 1031 corresponding to the first emission surface 1023*a* are shown. The optical axis C and the rear focal point F of FIG. 7 may be understood as the optical axis and the rear focal point of the first lens 1031. Locations of the optical axis and the rear focal point of the second lens 1032 and the third lens 1033 may be the same or different depending on the position difference from the first lens 1031.

Figure 8:
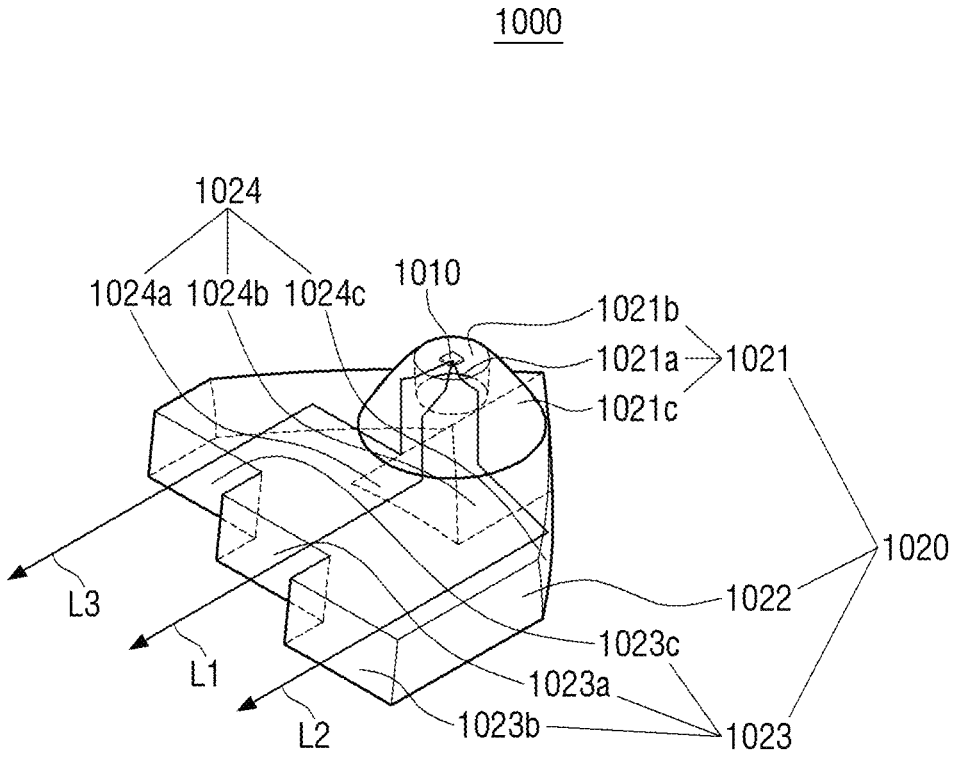
FIG. 8 is a schematic view showing light paths through which light is incident on and emitted from a light guide unit according to the embodiment of the present disclosure.

FIG. 8 is a schematic view showing light paths through which the light is incident on and emitted from the light guide unit according to the embodiment of the present disclosure. Referring to FIG. 8, the light that is incident on the incidence portion 1021 of the light guide unit 1020 may be reflected by the plurality of reflection surfaces 1024*a*, 1024*b*, and 1024*c* and may be emitted through the plurality of emission surfaces 1023*a*, 1023*b*, and 1023*c*.

Specifically, a light L1 reflected by the first reflection surface 1024*a* among the lights incident on the incidence portion 1021 may be emitted through the first emission surface 1023*a*. Lights L2 and L3 reflected to the sides by the second reflection surface 1024*b* among the lights incident on the incidence portion 1021 may be reflected eventually in a forward direction by the third reflection surface 1024*c* and be emitted through the second emission surface 1023*b* and the third emission surface 1023*c*, respectively.

The reflection portion 1024 including the first to third reflection surfaces 1024*a*, 1024*b*, and 1024*c* is merely an example for better understanding of the present disclosure, and the present disclosure is not limited thereto. The number and/or locations of reflection surfaces included in the reflection portion 1024 may be variously changed depending on the locations of the first to third emission surfaces 1023*a*, 1023*b*, and 1023*c*.

The optical unit 1030 may transmit the light guided and emitted by the light guide unit 1020 to form the beam pattern suitable for the purpose of the vehicle lamp 1 according to the present disclosure. As described above, the optical unit 1030 may include the plurality of lenses 1031, 1032, and 1033 so that the light source unit 1010 and the light guide unit 1020 may be commonly used for the plurality of lenses 1031, 1032, and 1033, thereby reducing the number of parts.

In other words, whereas if the light source unit 1010 and the light guide unit 1020 are individually provided for each of the plurality of lenses 1031, 1032, and 1033, the number of parts would increase, the cost can increase, and the configuration can become more complicated, in the embodiment of the present disclosure, since the light source unit 1010 and the light guide unit 1020 may be commonly used for the plurality of lenses 1031, 1032, and 1033, the cost may be reduced and the configuration may be simplified.

The above-described optical unit 1030 may allow the first lens 1031 to transmit the light emitted from the first emission surface 1023*a*, and the second lens 1032 and the third lens 1033 to transmit the light emitted from the second emission surface 1023*b* and then the third emission surface 1023*c* to form the beam pattern suitable for the purpose of the vehicle lamp 1.

The optical unit 1030 may include an odd number of lenses, such that the number of lenses disposed at left and right with respect to the central lens are the same. With such a configuration, the pattern region formed by the light radiated from the lamp module 1000 may be formed to be symmetrical in a left-right direction with respect to the center, thereby preventing a sense of heterogeneity in the beam pattern.

In the embodiment of the present disclosure, a case in which the optical unit 1030 includes three lenses is described as an example, but the present disclosure is not limited thereto. The optical unit 1030 may include any odd number of lenses such as 5, 7, and so on.

In addition, the optical unit 1030 according to the present disclosure may include the odd number of lenses so that the beam pattern suitable for the purpose of the vehicle lamp 1 may be formed. However, the optical unit 1030 may also include an even number of lenses depending on the purpose of the vehicle lamp 1 according to the present disclosure.

Figure 9:
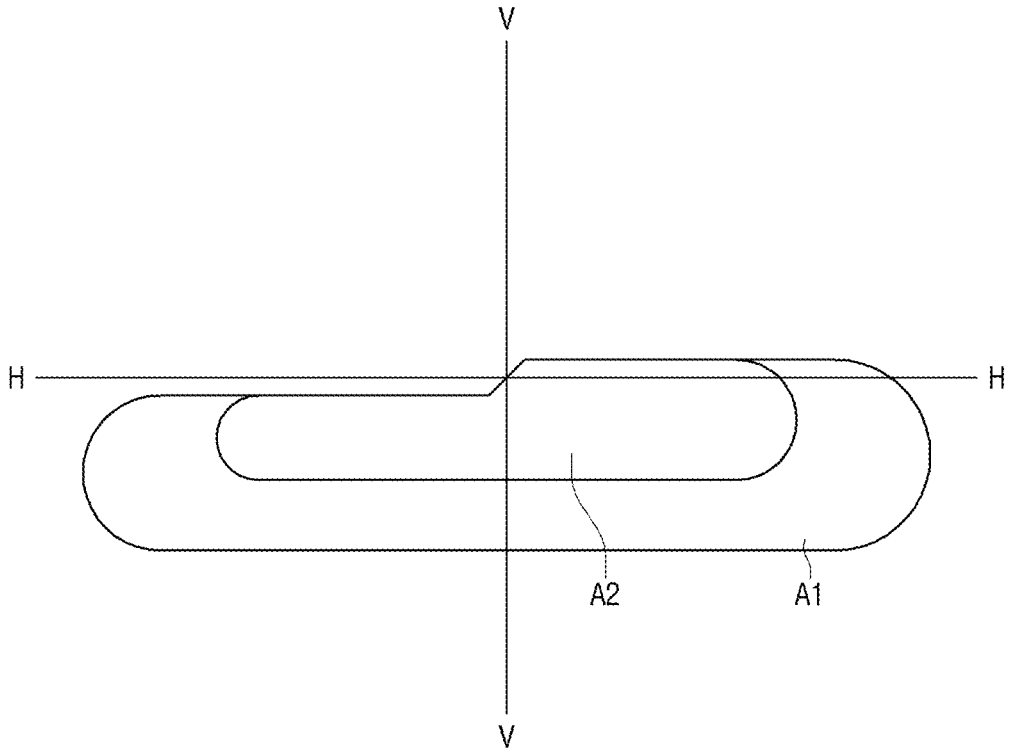
FIG. 9 is a schematic view showing a beam pattern formed by the vehicle lamp according to the embodiment of the present disclosure.

Further, a plurality of lamp modules 1000 may be provided to allow different pattern regions of the beam pattern to be formed by the vehicle lamp 1 according to the present disclosure. For example, as shown in FIG. 9, when the low beam pattern is formed by the vehicle lamp 1 according to the present disclosure, some of the plurality of lamp modules 1000 may form a spread region A1 of the low beam pattern, and some other of the plurality of lamp modules 1000 may form a high illuminance region A2 of the low beam pattern.

In the embodiment of the present disclosure, some of the plurality of lamp modules 1000 may be formed to have a shape of the emission portion of the light guide unit different from others so that some of the plurality of lamp modules 1000 may have light distribution characteristics different from others.

In other words, the beam pattern suitable for the purpose of the vehicle lamp 1 according to the present disclosure may be formed by the light radiated from the plurality of lamp modules 1000, and some of the plurality of lamp modules 1000 may form a first region of the beam pattern, and some others of the plurality of lamp modules 1000 may form a second region of the beam pattern. Hereinafter, in the embodiment of the present disclosure, a case in which the low beam pattern is formed by the vehicle lamp 1 according to the present disclosure, the spread region of the low beam pattern is formed by some (e.g., a first group) of the plurality of lamp modules 1000, and the high illuminance region of the low beam pattern is formed by some other (e.g., a second group) of the plurality of lamp modules 1000 will be described as an example.

Figure 10:
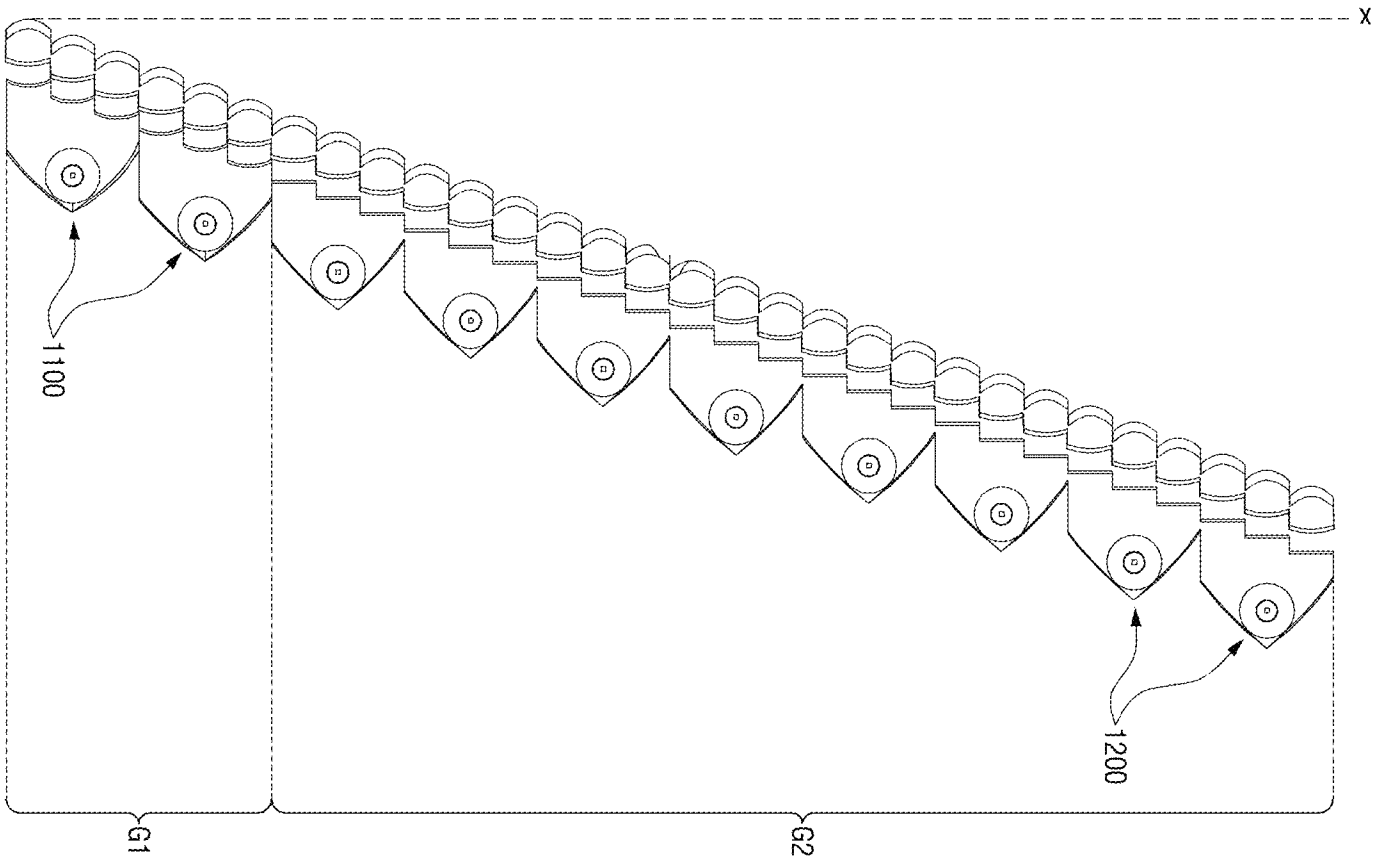
FIG. 10 is a schematic view showing a first lamp module and a second lamp module for forming different regions of the beam pattern according to the embodiment of the present disclosure.

In the embodiment of the present disclosure, as shown in FIG. 10, some of the plurality of lamp modules 1000, which are disposed closer to the center of the vehicle in the vehicle width direction x, may form a first group G1 that forms the spread region of the low beam pattern, and the others disposed more outward than the first group G1 may form a second group G2 that forms the high illuminance region of the low beam pattern. Herein, a lamp module belonging to the first group G1 of the plurality of lamp modules 1000 may be referred to as a "first lamp module," and a lamp module belonging to the second group G2 may be referred to as a "second lamp module."

Figure 11:
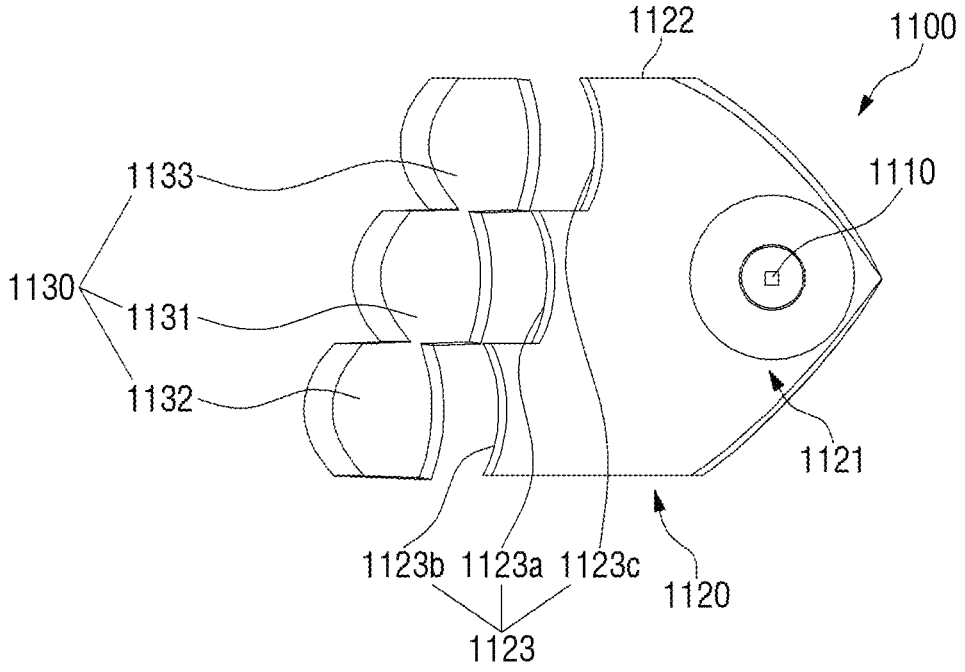
FIG. 11 is a plan view showing the first lamp module according to the embodiment of the present disclosure.

FIG. 11 is a plan view showing a first lamp module according to the embodiment of the present disclosure. Referring to FIG. 11, a first lamp module 1100 may include a first light source unit 1110, a first light guide unit 1120, and a first optical unit 1130 similarly to the above-described embodiment. The first light source unit 1110, the first light guide unit 1120, and the first optical unit 1130 may play substantially the same roles as those of the light source unit 1010, the light guide unit 1020, and the optical unit 1030 in the above-described embodiment, and therefore, detailed descriptions will be omitted.

The first light guide unit 1120 may include a first incidence portion 1121, a first transmission portion 1122, and a first emission portion 1123, and the first emission portion 1123 may include a plurality of emission surfaces 1123*a*, 1123*b*, and 1123*c* that correspond to a plurality of lenses 1131, 1132, and 1133 included in the first optical unit 1130.

In order to improve the light spreading characteristics, the first emission portion 1123 may include the plurality of emission surfaces 1123*a*, 1123*b*, and 1123*c* having a curved shape, so that the light emitted through each of the plurality of emission surfaces 1123*a*, 1123*b*, and 1123*c* may spread more when transmitted through the plurality of lenses 1131, 1132, and 1133 of the first optical unit 1130.

In the embodiment of the present disclosure, a case in which the plurality of emission surfaces 1123*a*, 1123*b*, and 1123*c* of the first emission portion 1130 have a concavely curved shape is described as an example, but the present disclosure is not limited thereto. The plurality of emission surfaces 1123*a*, 1123*b*, and 1123*c* may have a convex shape, a concave shape, or a combination thereof based on the required beam spread characteristics.

Figure 12:
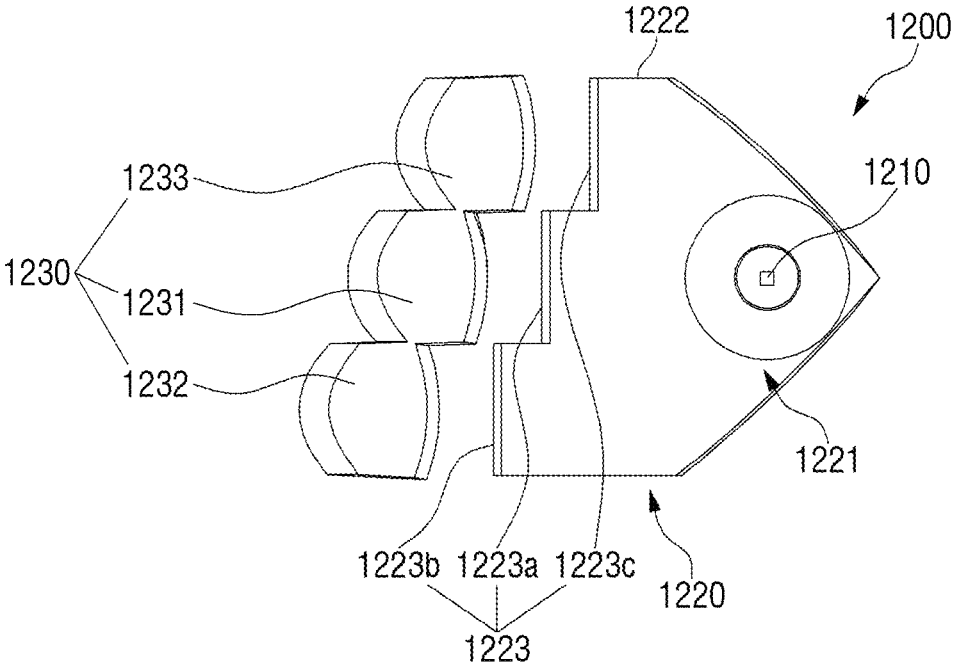
FIG. 12 is a plan view showing the second lamp module according to the embodiment of the present disclosure.

FIG. 12 is a plan view showing a second lamp module according to the embodiment of the present disclosure. Referring to FIG. 12, a second lamp module 1200 may include a second light source unit 1210, a second light guide unit 1220, and a second optical unit 1230 similarly to the above-described embodiment. The second light source unit 1210, the second light guide unit 1220, and the second optical unit 1230 may play substantially the same roles as those of the light source unit 1010, the light guide unit 1020, and the optical unit 1030 of the above-described embodiment, and therefore, detailed descriptions will be omitted.

The second light guide unit 1220 may include a second incidence portion 1221, a second transmission portion 1222, and a second emission portion 1223, and the second emission portion 1223 may include a plurality of emission surfaces 1223*a*, 1223*b*, and 1223*c* that correspond to a plurality of lenses 1231, 1232, and 1233 included in the second optical unit 1230.

In order to satisfy light distribution characteristics by improving the light concentration for the high illuminance region, in which a relatively high brightness is required, the second emission portion 1223 may include the plurality of emission surfaces 1223*a*, 1223*b*, and 1223*c* having a planar shape, so that the light emitted through each of the plurality of emission surfaces 1223*a*, 1223*b*, and 1223*c* may have a higher light concentration compared to the first lamp module 1100 when transmitted through the plurality of lenses 1231, 1232, and 1233 of the second optical unit 1230, thereby forming the high illuminance region A2.

Referring back to FIGS. 1 to 4, as the plurality of lamp modules 1000 are arranged such that they are progressively disposed more rearward going from the center of the vehicle toward the outer side of the vehicle in the vehicle width direction x, the optical unit 1030 of each of the plurality of lamp modules 1000 may also be disposed progressively rearward going from the center of the vehicle toward the outer side of the vehicle in the vehicle width direction x. In this case, the plurality of lenses 1031, 1032, and 1033 included in the optical unit 1030 may have a stepped portion such that the plurality of lenses 1031, 1032, and 1033 are also disposed progressively rearward going from the center of the vehicle toward the outer side of the vehicle in the vehicle width direction. Further, the emission portion 1023 of the light guide unit 1020 may have a stepped portion so that the plurality of emission surfaces 1023*a*, 1023*b*, and 1023*c* are also disposed progressively rearward going from the center of the vehicle toward the outer side of the vehicle in the vehicle width direction.

As described above, the vehicle lamp 1 according to the present disclosure can provide a slimmer form factor in the left-right direction compared to the up-down direction due to the plurality of lamp modules 1000 disposed in the vehicle's width direction x and can allow the light source unit 1010 and the light guide unit 1020 to be commonly used for the plurality of lenses 1031, 1032, and 1033 included in the optical unit 1030 of each of the plurality of lamp module 1000, thereby reducing the number of parts, simplifying the configuration, and reducing the cost.

In concluding the detailed description, those skilled in the art will appreciate that many variations and modifications can be made to the exemplary embodiments without substantially departing from the principles of the present invention. Therefore, the disclosed exemplary embodiments of the invention are used in a generic and descriptive sense only and not for purposes of limitation.

What is claimed is:

1. A lamp module comprising:

a light source unit that generates light;

a light guide unit that guides the light incident on an incidence portion from the light source unit to be emitted to an emission portion; and an optical unit that transmits the light emitted from the light guide unit to allow a predetermined beam pattern to be formed, wherein the optical unit includes a plurality of lenses disposed in a vehicle width direction, wherein the emission portion of the light guide unit includes a plurality of emission surfaces disposed in the vehicle width direction such that each of the emission surfaces directs at least a portion of the light from the light source unit to a corresponding lens of the plurality of lenses of the optical unit.

2. The lamp module of claim 1, wherein the light guide unit further includes a transmission portion configured to transmit the light incident on the incidence portion to the emission portion that is disposed in front of the incidence portion, and wherein the transmission portion is formed to extend in a front-rear direction.

3. The lamp module of claim 2, wherein the light guide unit further includes a reflection portion including at least one reflection surface configured to reflect the light incident on the incidence portion to the transmission portion.

4. The lamp module of claim 2, wherein a lower surface of the transmission portion is disposed at or near an optical axis of the optical unit, and wherein a front end of the transmission portion is disposed at or near a rear focal point of the optical unit.

5. The lamp module of claim 1, wherein each of the plurality of emission surfaces exhibits a planar shape or a curved surface.

6. The lamp module of claim 1, wherein adjacent emission surfaces of the plurality of lenses are arranged with a stepped portion formed therebetween such that the emission surfaces of the plurality of lenses are disposed progressively forward or rearward going from one side toward the other side in the vehicle width direction, and wherein the plurality of emission surfaces of the light guide unit have a stepped portion corresponding to an arrangement of the plurality of lenses of the optical unit.

7. The lamp module of claim 1, wherein each of the plurality of lenses and the plurality of emission surfaces are respectively formed in an odd number.

8. A vehicle lamp configured to allow a predetermined beam pattern to be formed by at least one lamp module, wherein the at least one lamp module includes a plurality of lamp modules disposed in a vehicle width direction, wherein each of the plurality of lamp modules includes:

a light source unit that generates light;

a light guide unit that guides the light incident from the light source unit to be emitted to an emission portion; and an optical unit that transmits the light emitted from the light guide unit to allow the predetermined beam pattern to be formed, wherein the optical unit includes a plurality of lenses disposed in the vehicle width direction, wherein the emission portion of the light guide unit includes a plurality of emission surfaces disposed in the vehicle width direction to correspond to the plurality of lenses of the optical unit, wherein the plurality of lamp modules include a first group configured to form a first region of the beam pattern and a second group configured to form a second region of the beam pattern, and wherein the plurality of emission surfaces of a lamp module belonging to the first group of the plurality of lamp modules have curvatures different from curvatures of the plurality of emission surfaces of a lamp module belonging to the second group of the plurality of lamp modules.

9. The vehicle lamp of claim 8, wherein the plurality of lamp modules are disposed to be inclined forward or rearward going from one side toward the other side in the vehicle width direction.

10. The vehicle lamp of claim 8, wherein the lamp module belonging to any one of the first group or the second group has the plurality of emission surfaces with a curved shape, and the lamp module belonging to the other of the first group or the second group has the plurality of emission surfaces with a planar shape.

11. A lamp module comprising:

a light source unit that generates light;

a light guide unit that guides the light incident on an incidence portion from the light source unit to be emitted to an emission portion; and an optical unit that transmits the light emitted from the light guide unit to allow a predetermined beam pattern to be formed, wherein the optical unit includes a plurality of lenses disposed in a vehicle width direction, wherein the emission portion of the light guide unit includes a plurality of emission surfaces disposed in the vehicle width direction to correspond to the plurality of lenses of the optical unit, wherein the light guide unit further includes a transmission portion configured to transmit the light incident on the incidence portion to the emission portion that is disposed in front of the incidence portion, wherein the transmission portion is formed to extend in a front-rear direction, wherein a lower surface of the transmission portion is disposed at or near an optical axis of the optical unit, and wherein a front end of the transmission portion is disposed at or near a rear focal point of the optical unit.

* * * * *